US005590450A

United States Patent [19]

March

[11] Patent Number: 5,590,450

[45] Date of Patent: Jan. 7, 1997

[54] METHOD OF SIZING OBJECTS

[76] Inventor: Michael A. March, 96 Caveney Dr., Northfield, N.H. 03276

[21] Appl. No.: 510,243

[22] Filed: Aug. 2, 1995

[51] Int. Cl.[6] ..... B23P 13/00

[52] U.S. Cl. ..... 29/8; 29/896.412; 29/401.1; 228/213; 63/15

[58] Field of Search ..... 29/8, 896.412, 29/401.1; 228/213; 63/15

[56] References Cited

U.S. PATENT DOCUMENTS 2,121,201 6/1938 Joyce ..... 29/896.412
3,017,754 1/1962 Manne et al. ..... 29/896.412
3,127,757 4/1964 Weiss ..... 29/896.412
4,785,647 11/1988 Coleman ..... 29/8

*Primary Examiner*—P. W. Echols
*Attorney, Agent, or Firm*—George E. Kersey

[57] ABSTRACT

Method and apparatus for the sizing of annular objects by cutting through an arcuate portion of the object to be sized; separating and straightening the cut ends of the object; placing sizing stock coated with solder into temporary adherence with a holder and then placing the stock, while held in the holder, between the cut ends; followed by heating the holder and the stock to release the sizing stock from the holder and cause solder paste to adhere the stock to the annular object between its cut ends.

10 Claims, 3 Drawing Sheets

METHOD OF SIZING OBJECTS

This invention relates to increasing the sizes of objects, such as finger rings, and more particularly, to the efficient and aesthetic sizing of finger rings.

BACKGROUND OF THE INVENTION

Items of jewelry, such as finger rings, often need to be increased in size. This may occur because changes in the fingers or other part of the body where the rings are worn, or because a ring or other item of jewelry may be given to a friend or relative and require a change in size. A reduction in size poses no problem, but increases in size are difficult to make efficiently and aesthetically.

It is standard practice to cut the bottom of the ring shank and insert sizing stock of the same material as the ring. An attempt is then made to solder the insert in place. Unfortunately, it is often difficult to place the sizing stock appropriately, and even when correctly placed the stock may slip during the soldering operation, resulting in a product that either requires re-sizing or has a less than satisfactory appearance.

In addition, the solder often runs over the adjoining part of the ring shank, again resulting in a less than satisfactory appearance. In some cases the solder is not uniformly applied, resulting in a weak joint that can easily become undone.

Accordingly, it is an object of the invention to facilitate the sizing of objects, particularly items of jewelry such as rings.

Another object of the invention is simplify the procedure for the proper fastening of sizing materials inserted between cuts at the bottom of the ring shank.

A further object is to insert sizing stock of the same material and external configuration as the ring in a way that makes it virtually impossible to tell that the ring has been sized.

Yet another object is to solder the insert in place without slippage during the soldering operation, resulting in a product that neither requires re-sizing nor has a less than satisfactory appearance.

A yet further object is to prevent the solder from running over the adjoining part of the ring shank, again resulting in a less than satisfactory appearance. A related object is to assure that the solder is uniformly applied, to achieve a strong joint that cannot easily become undone.

SUMMARY OF THE INVENTION

In accomplishing the foregoing and related objects, the invention provides for the sizing of objects by a holder for sizing stock and temporarily adhering the sizing stock in the holder.

In accordance with one aspect of the invention, the sizing stock is temporarily adhered to the holder by adhesive that releases its hold in the presence of heat above ambient. The sizing stock is temporarily adhered to the holder by cyanoacrylate adhesive that releases its hold in the presence of heat above ambient.

The sizing stock adhered to the holder has opposite ends and solder paste is applied to each end. The sizing stock also has a prescribed length and the holder has a length exceeding that of the sizing stock. The holder further has a width and the sizing stock has a width less than that of the holder.

The holder has a base and a side extending from the base, with the sizing stock positioned on the base against the side. The sizing stock is available in a plurality of different lengths.

In a method of sizing an object in accordance with the invention, the steps include (a) cutting the object to be sized; (b) separating and straightening the cut ends of the object; and (c) placing a holder containing temporarily adhered sizing stock with solder paste between the cut ends; and (d) heating the sizing stock to release the holder and cause solder paste to adhere the stock to the object between the cut ends.

In accordance with one aspect of the invention, the method includes the step of forming, between the cut ends, an opening which is smaller than the length of the stock. This ensures a tight butt joint between the stock and the ends of the object.

The method further includes the step of coating the object up to the cut ends with antiflux to trap the solder paste between the stock and the object, and limit the extent to which solder will flow onto the object beyond the cut when heat is applied. The antiflux is selected from the class of particulates including calcium carbonate and ochre (iron pigment).

The holder is provided with a flat base for positioning against the straightened portion of the object to assure proper alignment of the stock between the cut ends. The stock is adhered to the holder by an adhesive which releases when the solder paste is heated to flow temperature.

The method includes the step of applying heat to the stock between the ends of the object to raise the solder paste to flow temperature. The stock can be heated by reciprocating a flame along the length of the stock while positioned between the cut ends of the object. The method flame can be produced by an oxy-acetylene torch. Alternatively, a carbon heater can be applied to the stock to cause solder paste to reach flow temperature.

In a method of fabricating apparatus for the sizing of stock, the steps include (a) temporarily positioning sizing stock having opposite ends on and against a holder extending beyond the opposite ends; and (b) applying solder paste at each end of the sizing stock.

DESCRIPTION OF THE DRAWINGS

Other aspects of the invention will become apparent after considering several illustrative embodiments, taken in conjunction with the drawings, in which.

DETAILED DESCRIPTION

Figure 1A:
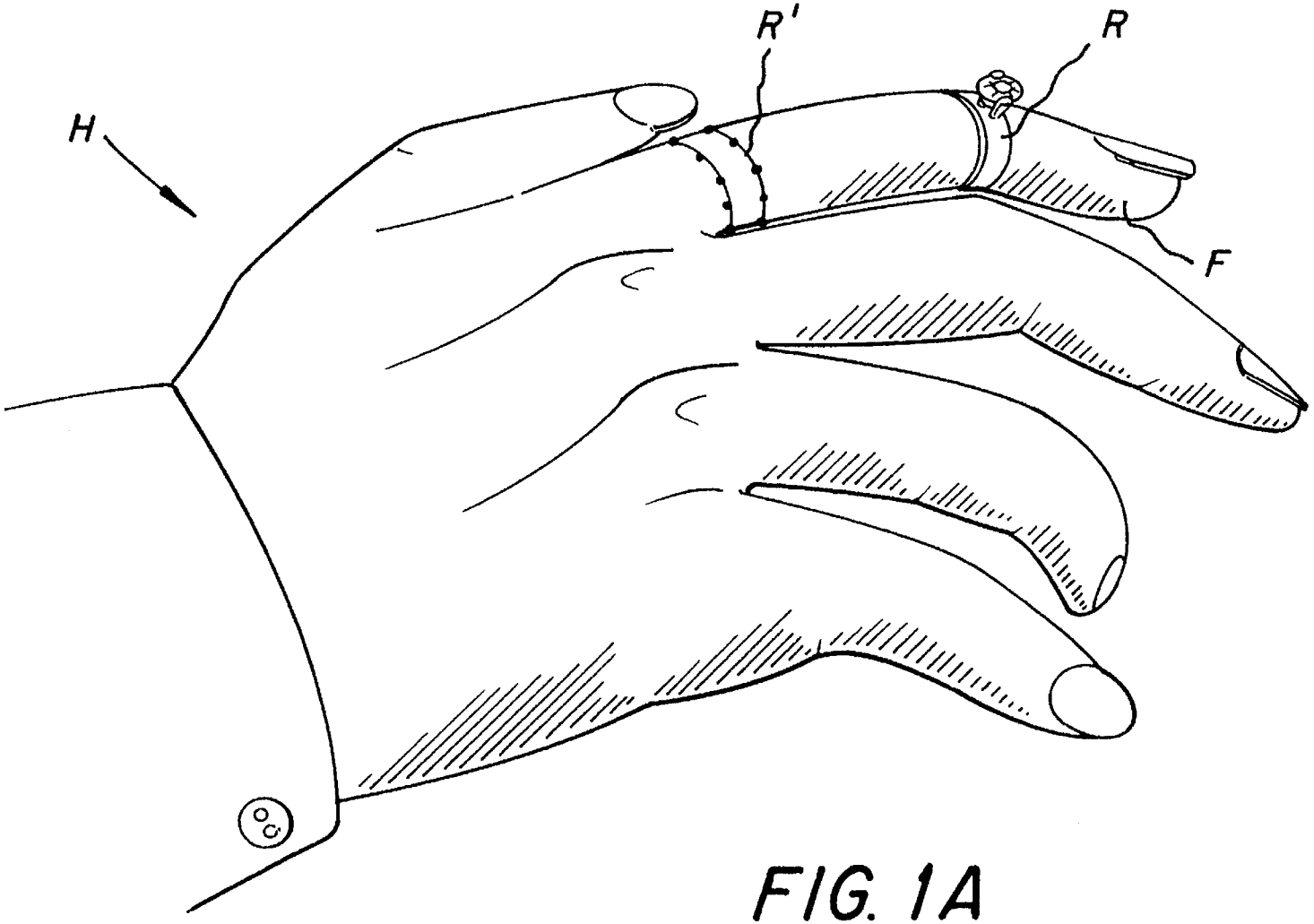
FIG. 1A is a perspective view of a hand attempting to receive an under-sized ring.

With reference to the drawings, a hand H is shown in FIG. 1A where an attempt has been made to position a ring R on a finger F in the phantom position R', but the attempt has been unsuccessful because the ring R is too small.

Figure 1C:
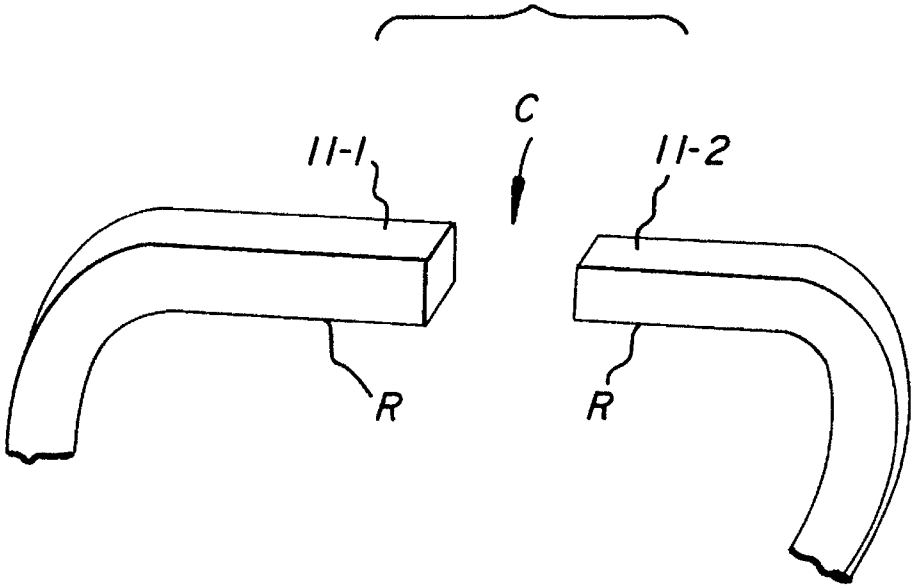
FIG. 1C is a perspective view of the ring of FIG. 1B with the bottom of its shank separated and temporarily straightened.
Figure 1B:
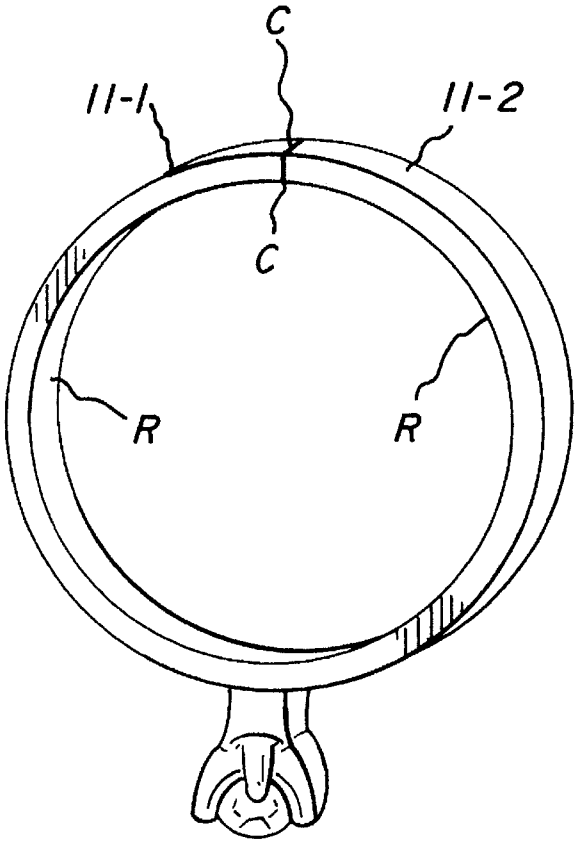
FIG. 1B is a perspective view of the ring of FIG. 1A.

In order to size the ring R to fit on the finger F of FIG. 1A a cut C is made on the bottom of the shank 10 as indicated in FIG. 1B. The ends 11-1 and 11-2 at the cut are then straightened and separated as shown in FIG. 1C. The ring R is now ready to be sized in accordance with the invention.

Figure 2:
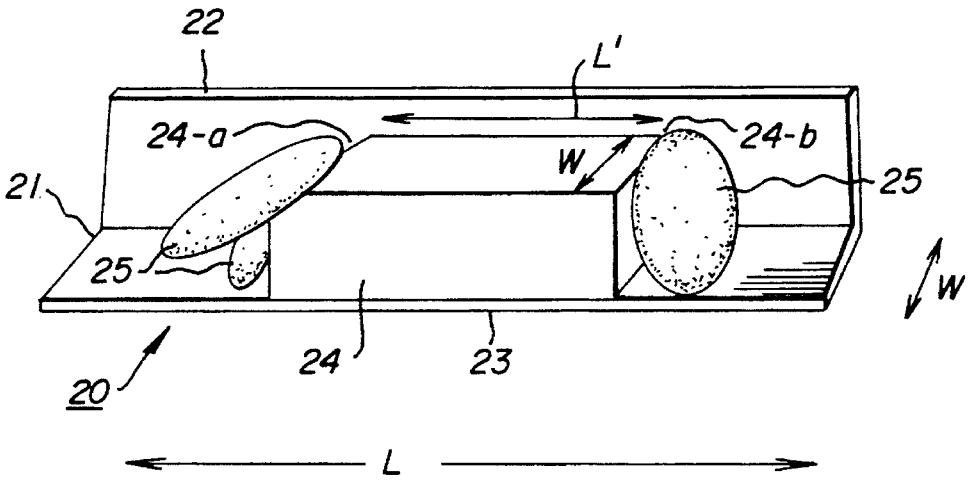
FIG. 2 is a perspective view of a holder with sizing stock in accordance with the invention.

As a first step in the sizing procedure the sizing tool 20 as shown in FIG. 2 is prepared by forming a holder 21, illustratively from a sheet of aluminum, with a 90-degree bend to form a back side 22 relative to a flat base 23. Sizing stock 24 is positioned against the side 22 and adhered to the base 23 by a suitable heat-responsive adhesive, such as a drop of cyanoacrylate. The holder 21 has a length L and a width W, both exceeding the length L' and the width W' of the stock 24. In addition solder paste 25 is applied at respective ends 24-a and 24-b of the sizing stock 24.

Figure 3:
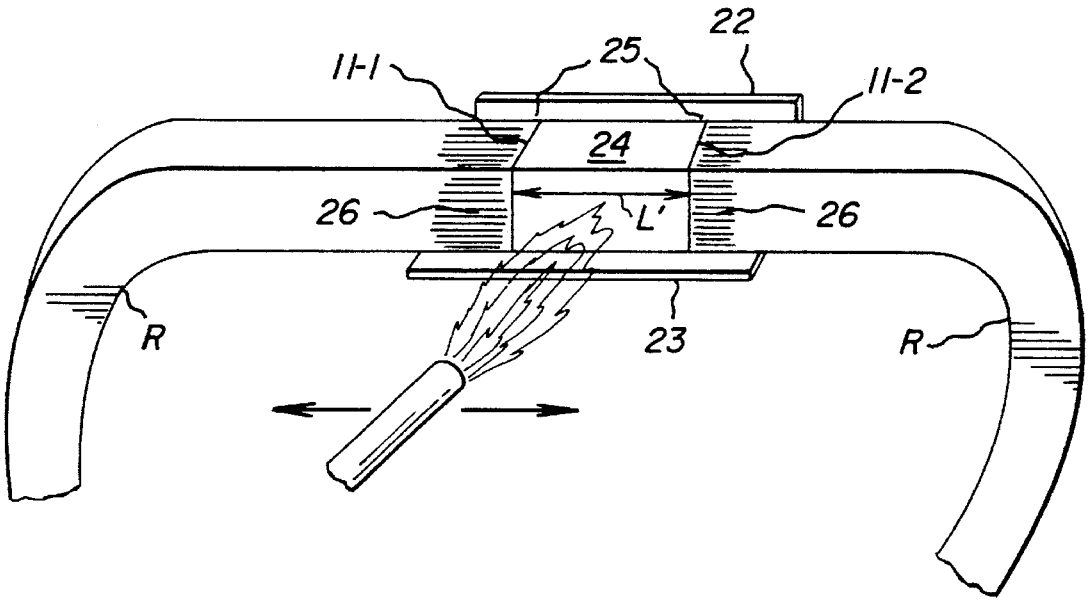
FIG. 3 is a perspective view of the ring of FIG. 2 with the bottom of its shank separated and temporarily straightened for receiving the holder of FIG. 2 and holding the sizing stock in place in accordance with the invention.

Once the sizing tool 20 has been formed, it is brought against the ring R as shown in FIG. 3, with the base 23 against the straightened portions of the ring R and the stock 24 between the cut ends 11-1 and 11-2. The opening between the ends 11-1 and 11-2 is slightly smaller than the length L' of the stock 24 in order to ensure a tight butt joint.

The region of the ring R, up to the cut ends 11-1 and 11-2 is coated with an antiflux 26 to limit flow of the solder paste 25 from the butt ends. A suitable antiflux is powdered calcium carbonate in a liquid carrier or ochre, which is iron pigment in a liquid carrier.

The final step is to apply heat to the stock 24 to release the adhesive that retains the stock 24 temporarily on the base 23 and to cause the solder paste 25 to reach its flow temperature and form a suitable seal at the ends 11-1 and 11-2. Excess solder paste will be trapped by the antiflux 26.

The heat may be applied in any suitable fashion, for example by reciprocating an oxy-acetylene flame or by using a carbon heater.

It will be understood that the foregoing description is for illustration only and that other adaptations and uses of the invention may be made without departing from the spirit and scope of the invention as set forth in the appended claims.

What is claimed:

1. The method of sizing an annular object, which comprises the steps of:

(a) cutting through an arcuate portion of the object to be sized;

(b) separating and straightening the cut ends of said object; and (c) placing sizing stock coated with solder in a holder; the stock being temporarily adhered to the holder; then placing the stock while held in the holder between the cut ends; and (d) heating said holder and said stock to release said sizing stock from said holder and cause said solder paste to adhere said stock to said object between said cut ends.

2. The method as defined in claim 1 including the step of forming an opening between said cut ends which is smaller than the length of said stock;

thereby to ensure a tight butt joint between said stock and the ends of said object.

3. The method as defined in claim 1 further including the step of coating the said object up to said cut ends with antiflux;

thereby to trap said solder paste between said stock and said object and limit the extent to which solder will flow onto said object beyond said cut when heat is applied.

4. The method as defined in claim 3 wherein said antiflux is selected from at least one of calcium carbonate and ochre (iron pigment).

5. The method as defined in claim 1 where said holder is provided with a flat base for positioning against the straightened portion of said object to assure proper alignment of said stock between said cut ends.

6. The method as defined in claim 5 wherein said stock is adhered to said holder by an adhesive which releases when said solder paste is heated to flow temperature.

7. The method as defined in claim 1 including the step of applying heat to said stock between the ends of said object to raise said solder paste to flow temperature.

8. The method as defined in claim 7 wherein said stock is heated by reciprocating a flame along the length of said stock while positioned between the cut ends of said object.

9. The method as defined in claim 8 wherein said flame is produced from an oxy-acetylene torch.

10. The method as defined in claim 7 where a carbon heater is applied to said stock to cause said solder paste to reach flow temperature.

* * * * *